US005170618A

United States Patent [19]

Hafner et al.

[11] Patent Number: 5,170,618

[45] Date of Patent: Dec. 15, 1992

[54] SPINNING MILL OVERHEAD CONVEYOR SYSTEM HAVING COMMON DRIVE FOR CLEANER AND BOBBIN CARRIERS

[75] Inventors: Josef Hafner; Rolf Schönenberger, both of Landsberg/Lech, Fed. Rep. of Germany

[73] Assignee: Veit Transpo GmbH, Fed. Rep. of Germany

[21] Appl. No.: 591,981

[22] Filed: Oct. 2, 1990

[30] Foreign Application Priority Data

Oct. 4, 1989 [DE] Fed. Rep. of Germany ... 8911853[U]

[51] Int. Cl.[5] ..... D01H 9/10; D01H 11/00

[52] U.S. Cl. ..... 57/281; 57/304

[58] Field of Search ..... 57/281, 300, 266, 90, 57/268, 270, 304; 242/35.5; 15/300.1, 301

[56] References Cited

U.S. PATENT DOCUMENTS

| | | | |
|---|---|---|---|
| 1,883,358 | 8/1930 | Ferguson | 57/300 |
| 3,112,601 | 12/1963 | McCullough | 57/268 |
| 3,828,682 | 8/1974 | Klein | 57/281 X |
| 3,935,821 | 2/1976 | Maier et al. | 57/281 X |
| 4,630,435 | 12/1986 | Igel | 57/281 |
| 4,660,367 | 4/1987 | Kawarabashi | 57/281 X |
| 4,841,719 | 6/1989 | Sasaki et al. | 57/281 |
| 4,999,988 | 3/1991 | Roder et al. | 57/281 |

FOREIGN PATENT DOCUMENTS

| | | | |
|---|---|---|---|
| 132134 | 10/1987 | European Pat. Off. | 57/281 |
| 0310871 | 4/1989 | European Pat. Off. | 57/281 |
| 059834 | 2/1983 | Japan | 57/300 |

*Primary Examiner*—Daniel P. Stodola
*Assistant Examiner*—John F. Rollins
*Attorney, Agent, or Firm*—Finnegan, Henderson, Farabow, Garrett & Dunner

[57] ABSTRACT

A spinning mill installation including an overhead conveyor system having rails for feeding and removing bobbins to and from at least one creel-less spinning machine. To provide the function of the absent creels, an array of rail elements is positioned above each spinning machine, the rail elements having detent mechanisms defining the locations of the bobbin stations, are provided in the overhead conveyor system. A cleaning device moves along an overhead rail and is provided with a driving device which also drives the bobbin carriers.

9 Claims, 5 Drawing Sheets

SPINNING MILL OVERHEAD CONVEYOR SYSTEM HAVING COMMON DRIVE FOR CLEANER AND BOBBIN CARRIERS

BACKGROUND OF THE INVENTION

The invention relates to a spinning mill installation including an overhead conveyor system of the type having rails for the feeding and removal of bobbins from one or more spinning machines.

An overhead conveyor system for a spinning mill installation of this type is known from DE-OS 37 34 505. This known spinning mill installation employs conventional ring spinning machines provided with bobbin carrier creel means. The creels of the ring spinning machines are connected with conveyor rails permitting bobbins to be directly fed to the creel means of the individual ring spinning machines. The creel also carries the slubbing guides and their mounting assemblies. In the known spinning mill installation, the overhead conveyor system is used for feeding full bobbins to the creel means of the ring spinning machines and for removing empty bobbin cores therefrom. In an installation of this type, the overhead conveyor system, i.e. the arrangement and spacing of the rails as well as the rail connections, have to be designed so as to conform to the construction of the specific ring spinning machines. Any replacement of the ring spinning machines thus requires corresponding modifications of the design and construction of the overhead conveyor system.

SUMMARY OF THE INVENTION

It is therefore an object of the invention to devise a spinning mill installation permitting the employed ring spinning machines to be replaced without problems.

This object is attained by a spinning mill installation having an overhead conveyor system and at least one spinning machine, the overhead conveyor system comprising rails for feeding and removal of hanging bobbins to and from the spinning machine, the conveyor system further comprising a plurality of creel rails arranged above and vertically distant to the spinning machine, the plurality of creel rails being provided with a plurality of bobbin locations, and being attached to a frame structure which is supported outside the spinning machine by a ceiling or a floor. remainder of the line in its entirety; and the characterizing features of claim 1.

As a result of the design and construction according to the invention, the functions to be performed by the creel of a conventional spinning machine are assumed by the overhead conveyor system, and "creel-less" spinning machines are utilized, thus permitting the spinning machine to be replaced without problems. It is thus for instance possible to modernize a spinning mill installation without an increase of the accrueing costs by a modification of the overhead conveyor system.

Advantageous additional aspects of the invention are disclosed in the succeeding discussion or are shown in the accompanying drawings. Particular advantages in this context derive from the provision that the system for the displacement of a cleaner device (blower) may be integrated in such a manner that it is possible to do without a separate rail system and/or a separate drive mechanism for the cleaner device. The drive system for the bobbin feeding operation and the displacement of the cleaner device, respectively, may also be designed for cooperation with two spinning machines at the same time. This is also conductive to saving investment and operation costs.

BRIEF DESCRIPTION OF THE DRAWING

Embodiments of the invention shall now be described in detail by way of example with reference to the accompanying drawings, wherein.

DESCRIPTION OF THE PREFERRED EMBODIMENTS

Figure 1:
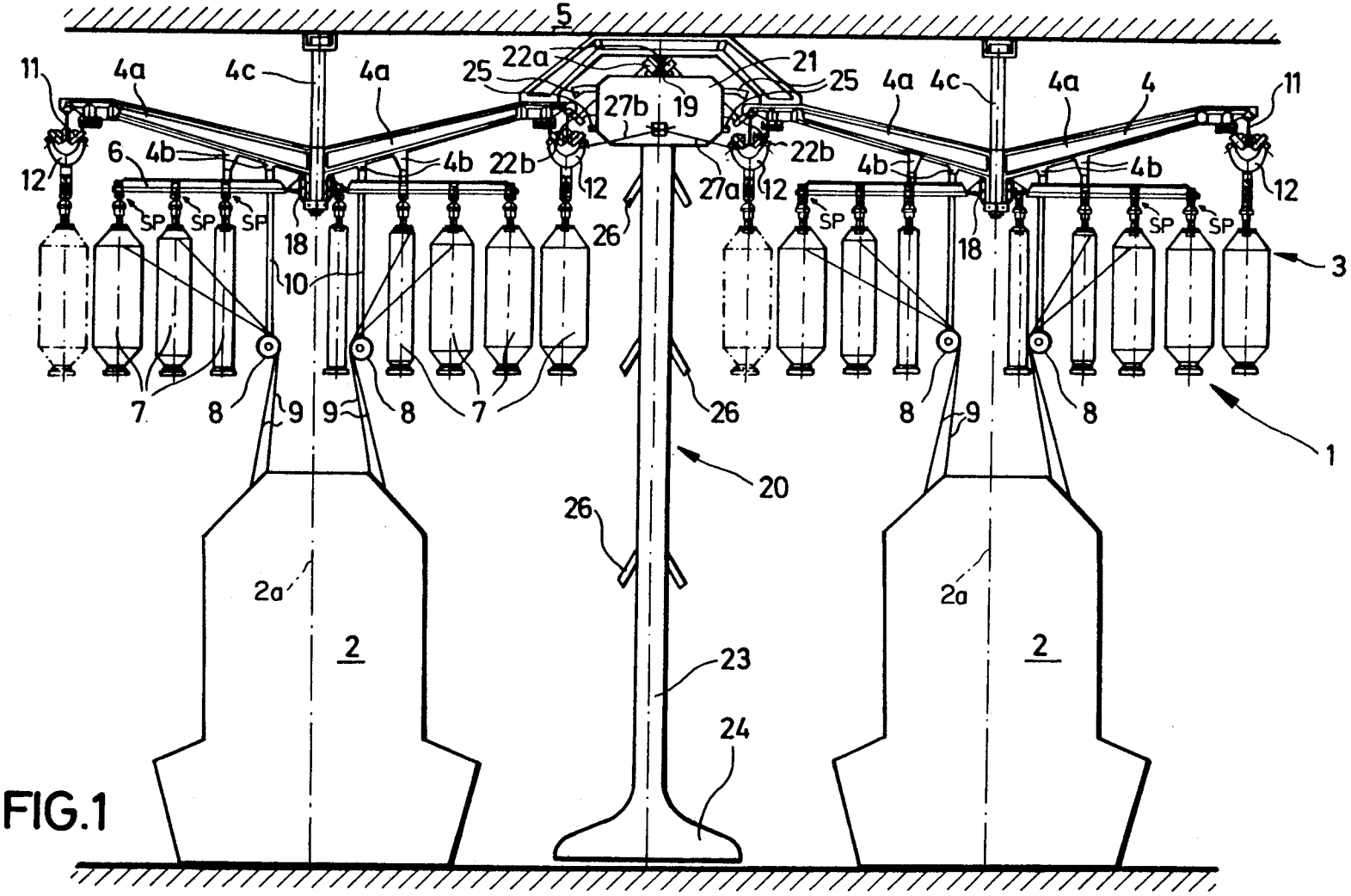
FIG. 1 shows a diagrammatic illustration of a first embodiment of a spinning mill installation.

The diagrammatic illustration of FIG. 1 shows parts of a spinning mill installation 1, the embodiment shown by way of example including two diagrammatically depicted spinning machines, specifically ring spinning machines 2, installed parallel to one another in the conventional manner and with the usual bobbin creel removed therefrom. Disposed above ring spinning machines 2 is an overhead conveyor system 3 comprising a frame structure 4 composed of a plurality of transverse carrier arms 4*a* and longitudinal carrier rails 4*b*. The transverse carrier arms 4*a* and longitudinal carrier rails 4*b* are suspended from the roof 5 or a ceiling of a workshop by suspension links 4*c*.

Figure 2:
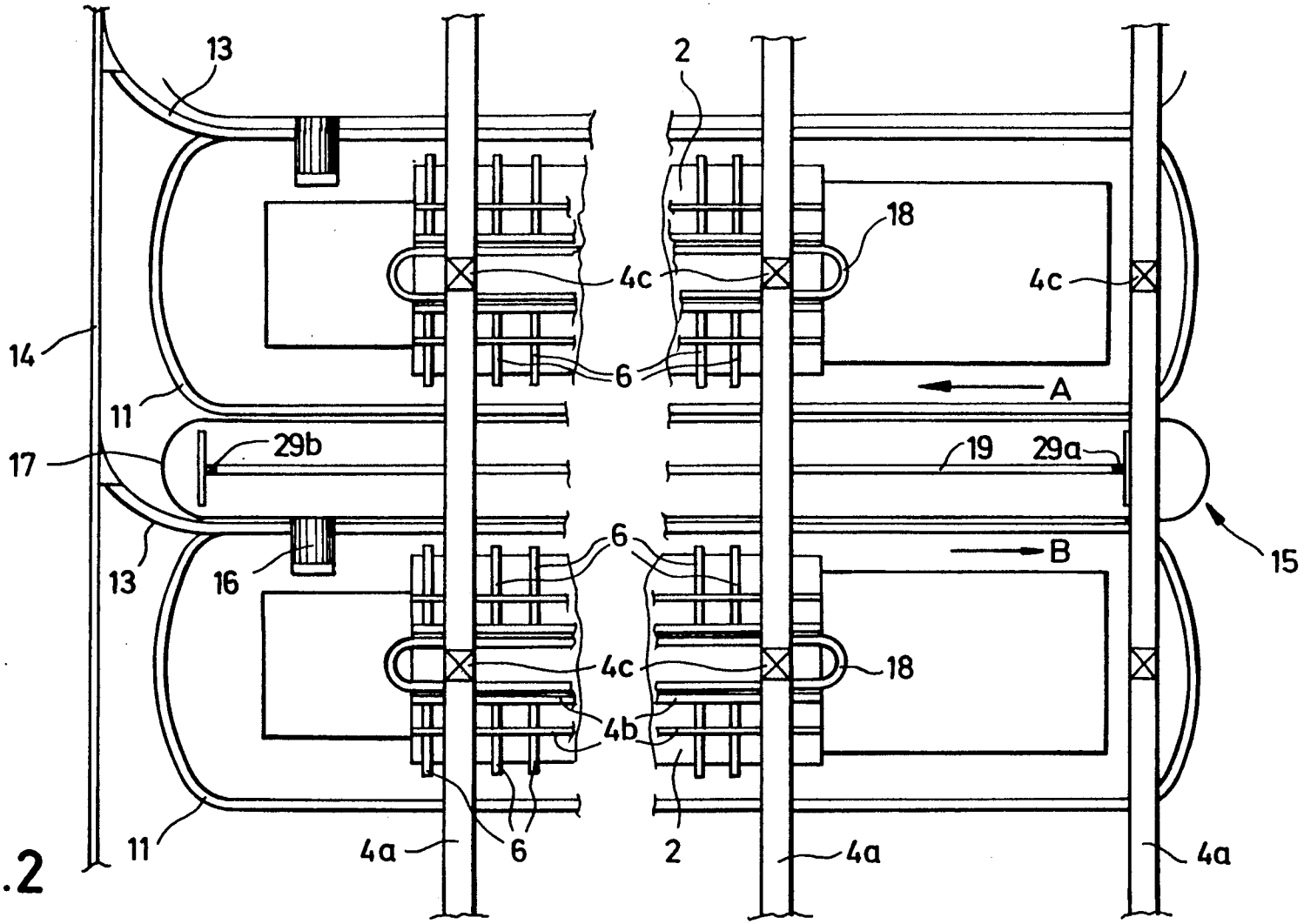
FIG. 2 shows a top plan view of the spinning mill installation according to FIG. 1.

As also evident in connection with FIG. 2, frame structure 4 is used for mounting a plurality of transverse rail elements 6 extending horizontally on both sides of the longitudinal symmetry plane of the ring spinning machines and arranged in an array. Transverse rails 6 thus extend parallel to one another and perpendicular to the longitudinal planes 29 of ring spinning machines 2. Defined on transverse rails 6 are bobbin stations SP for bobbins to be spin-stripped, the number of such stations at least corresponding to the number of spinning stations of ring spinning machine 2. In the embodiment shown, there are additionally provided bobbin stations greater than the number of bobbins being spin-stripped for use by stand-by bobbins.

Suspended from frame structure 4 by means of suspension links 10 are guides 8 for guiding the slubbings 9 to be spin-stripped from bobbins 7. Guides 8 may be in the form of sheaves, in which case a separate guide is provided for each slubbing 9. It is also possible to provide a common guide 8 for all of the slubbings 9 on each side of the symmetry plane 29 of ring spinning machine 2, in the form of respective bars extending over the full length of the ring spinning machine 2.

Frame structure 4 additionally carries a rail track 11 forming a closed path extending about a respective one of ring-spinning machines 2 outside of transverse rails 6. Rail track 11 is used for feeding full bobbins 7 suspended from carriers 12 to the respective ring spinning machine 2, and connected via suitable switch points 13 to a supply rail track 14. The carriers 12 used in the illustrated example are of the generally known type comprising a stirrup hanger with two casters aligned at right angles to one another and adapted to run on runways of a rail having triangular cross-sectional shape. It is also possible, however, to employ carriers of a different type.

The carriers 12 of the bobbins 7 to be fed are entrained by a drive mechanism 15 comprising an endless entrainment member 17 in the form for instance of a chain to which carriers 12 are connected, or of a belt provided with lugs engaging carriers 12, or in the form of a friction belt cooperating with the casters of carriers 12,, and a motor 16 for driving the mechanism. Entrainment member 17 is disposed in the space between two adjacent ring spinning machines 2 and effective to entrain the carriers on rail tracks 11 of both ring spinning machines 2. The bobbins 7 fed along rail tracks 11 are transferred onto transverse rails 6 in a conventional manner, for instance by means of switch points or by manual transfer, to replace empty bobbins 7 on rails 6. Particularly when the transfer onto transverse rails 6 is by an automatic operation, the empty bobbins 7 are displaced towards the longitudinal center plane of ring spinning machine 2 and transferred thereat onto a discharge conveyor 18 operable to carry the empty bobbin cores away from the vicinity of the spinning stations. Discharge conveyor 18 may again be designed as a known endless conveyor provided with lugs or the like for engaging and entraining the bobbin cores. Discharge conveyor 18 is also carried by frame structure 4.

Extending in the space between the two ring spinning machines 2 and parallel to the longitudinal center planes thereof is a further rail 19 for a cleaner device 20 in the form of a blower having a blower head 21 provided with casters 22*a* aligned at right angles to one another and adapted to run on correspondingly aligned runways of rail 19, formed to this purpose with a triangular cross-sectional shape. Blower head 21 is provided with further casters 22*b* acting as guide rollers and running on respective additional runways of the rail tracks 11 of the adjacent ring spinning machines. A tube 23 extending vertically downwards from blower head 21 has its lower end connected to an aspirator funnel 24. From the sides of blower head 21, blower nozzles 25 project laterally to locations adjacent overhead conveyor system 3 for keeping the latter free of fluff. Tube 23 is likewise provided with blower nozzles 26 directed towards components on the opposing sides of the two adjacent ring spinning machines 2 to prevent the accumulation of fluff thereon. In this manner it is possible to use a single cleaner device 20 for cleaning the opposing sides of two adjacent ring spinning machines. The cleaner device 20 according to this example is particularly useful when two ring spinning machines 2 are placed relatively close to one another for space-saving purposes, for instance when the automatic replacement of spin-stripped bobbins permits the space otherwise required between the two ring spinning machines for a bobbin trolley to be saved.

Figure 4:
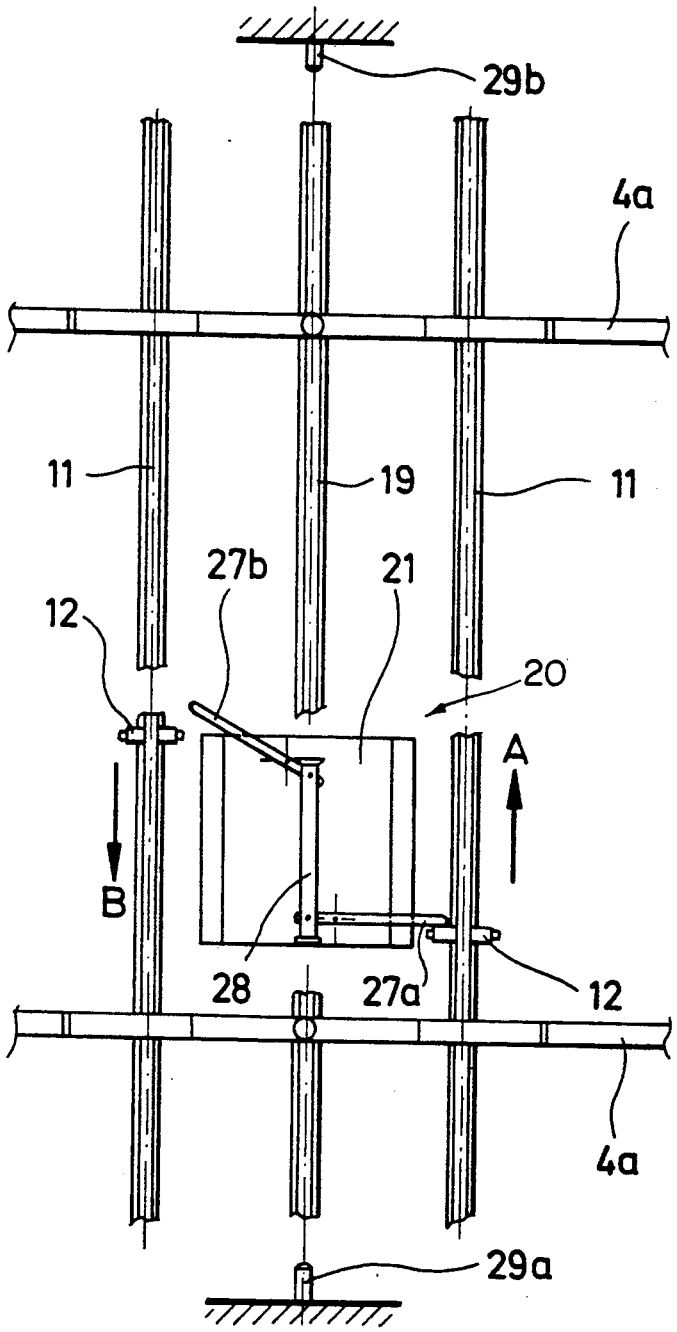
FIG. 4 shows a top plan view of a cleaner device.

As particularly evident in connection with FIG. 4, cleaner device 20 is entrained by the feed movement of bobbin-feeding carriers 12. To this purpose blower head 21 carries two hitch levers 27*a*, 27*b* mounted thereon for pivotal displacement about respective axes. At respective ones of their ends, the two-armed hitch levers 27*a*, 27*b* are interconnected by a link bar 28 adapted to be shifted in the displacement direction of cleaner device 20 between two positions and to be locked thereat. The length of link bar 28, the length of hitch levers 27*a*, 27*b* and the locations of the pivot axes of hitch levers 27 are so determined that in any of the two positions of link bar 28 one of the hitch levers 27 projects into the path of the carriers on the adjacent rail track 11, while the other hitch levers is retracted from the path of the carriers on rail track 11 of the other ring spinning machine 2. Rail 19 of cleaner device 20 is provided adjacent both of its ends with respective stop pins 29*a*, 29*b* cooperating with respective ends of link bar 28. Since the carriers 12 running on the two rail tracks 11 in FIG. 4 are entrained by a common drive mechanism 15 as shown in FIG. 2, the carriers 12 on the sections of rail tracks 11 on opposite sides of rail 19 move in opposite directions, as indicated by arrows A and B in FIGS. 2 and 4. In the state depicted in FIG. 4, hitch lever 27*a* thus acts to entrain cleaner device 20 in the direction of arrow A until link bar 28 abuts stop pin 29*b*. This causes link bar 28 to be shifted to its other position, so that hitch lever 27*b* will then be engaged by a carriage 12, while hitch lever 27*a* is retracted.

Figure 3:
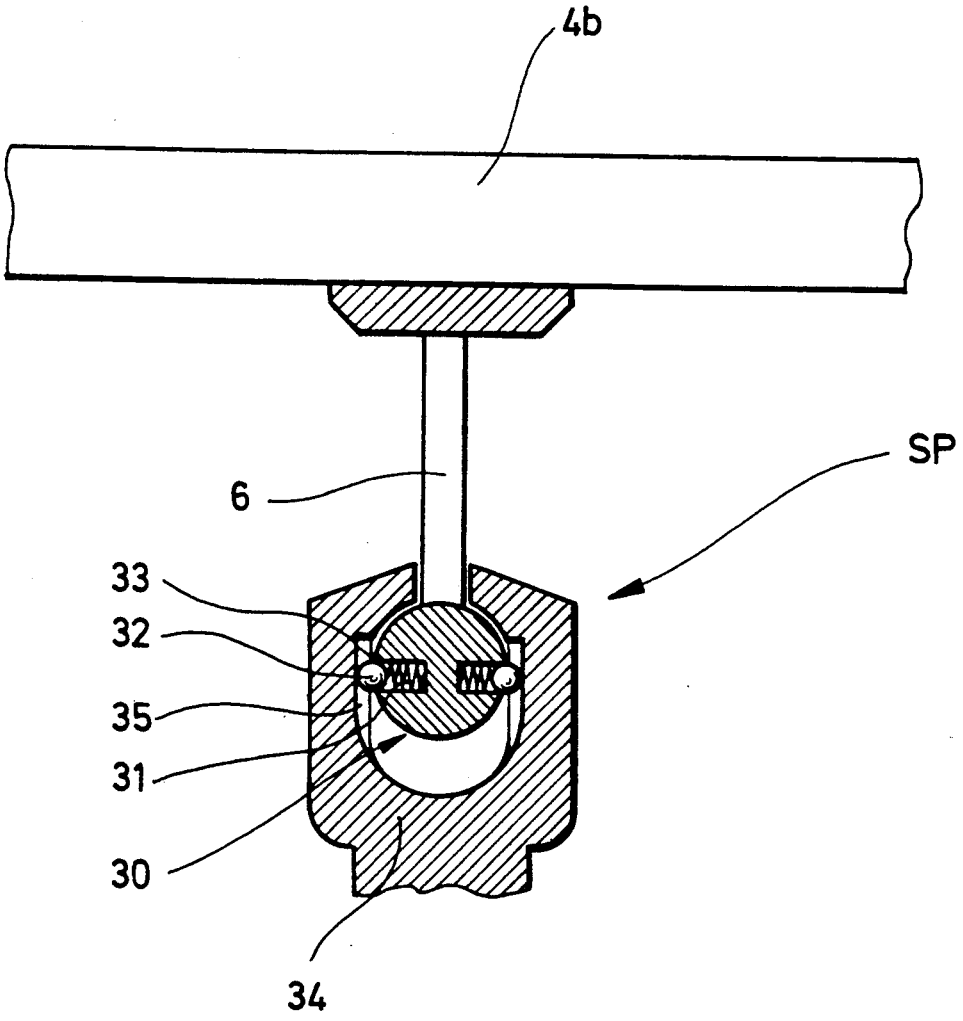
FIG. 3 shows a sectional view of a bobbin station in the installation according to FIG. 1.

As shown in FIG. 3, each of the bobbin stations SP indicated in FIG. 1 is provided with a readily releasable detent mechanism 30 comprising a detent ball 32 retained in a bore 33 of transverse rail 6 and biased by a spring 31 into engagement with a detent grove 35 in a bobbin holder 34. The detent mechanism 30 may also comprise two detent balls 32 symmetrically disposed on opposite sides of an individual rail 6. The described design results in a readily releasable detent mechanism 30 which is nevertheless effective to prevent the spacing of bobbins 7 suspended from transverse rails 6 from being changed by the tractive forces acting on slubbings 9 as they are being spin-stripped while releasing for movement along rail element 6 under moving forces generated by conventional moving means.

Figure 5:
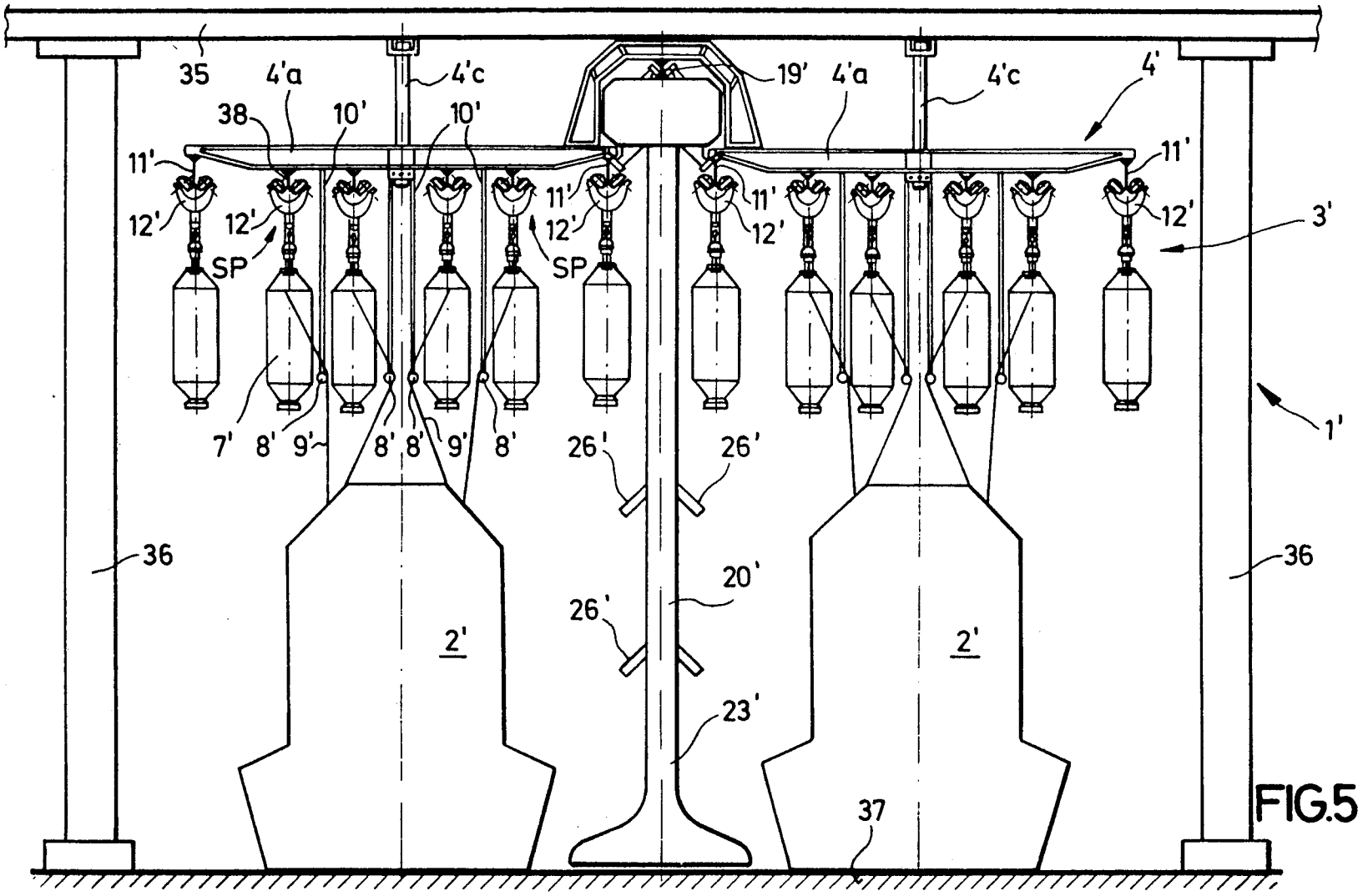
FIG. 5 shows a diagrammatic illustration of another embodiment of a spinning mill installation.

FIG. 5 shows, by way of example, a second embodiment of a spinning mill installation 1', wherein equal or similar components are designated by the same reference numerals, supplemented by a quotation mark, and shall not again be described in detail. This embodiment again provides the employ of creel-less ring spinning machines 2', the functions of a creel being again assumed by an overhead conveyor system 3' comprising a frame structure 4' with transverse carrier arms 4*a*' suspended by suspension links 4*c*' from girders 35 supported by columns 36 resting on the floor 37 of a workshop.

Feeder rail tracks 11' may be formed as closed loops as in the preceding example, or as parallel rails.

The overhead conveyor system 3' of this embodiment is designed for feeding the bobbins 7 to be spin-stripped in the longitudinal direction, i.e. parallel to the length of ring spinning machines 2'. To this purpose, a suitable number (in the example shown, two groups of two rails) of longitudinal rails 38 is provided above each ring spinning machine 2' for the accommodation of the required number of bobbin stations SP. When each bobbin has its own carrier 12', the bobbin stations may be provided directly on longitudinal rails 38. It is also possible, however, to employ conveying units in the form of bobbin trains each composed of two carriers and an interconnecting longitudinal bar having a pluraility of bobbins suspended therefrom. In this case the bobbin stations would have to be provided on the longitudinal bar.

Suspended from transverse carrier arms 4*a*' by means of suspension links 10' are the already described guides 8' for guiding the slubbings 9'. In the example shown, a separate guide 8' is provided for each bobbin station SP. The required spacing between the bobbins 7' to be spin-stripped may be maintained by suitable spacers of a known type, in which case the bobbins need not be locked at their bobbin stations by means of cam members or the like.

In modifications of the described and illustrated embodiments it is of course also possible to interchange the details depicted in the various figures. The overhead conveyor system 3 of FIG. 1 may thus be supported on the floor, or the overhead conveyor system 3' of FIG. 5 may be suspended from the ceiling. Likewise possible is the combined employ of both these mounting arrangements, or the mounting of the overhead conveyor system on any other suitable support. The employ of other carriers of known types and of rails of different cross-sectional shapes is also admissible. The basic concept of the invention, namely, the delegation of functions of a spinning machine to an overhead conveyor system, is also applicable to other types of spinning machines.

We claim:

1. A spinning mill installation including an overhead conveyor system and at least one spinning machine, said overhead conveyor system comprising rails for feeding and removal of hanging bobbins to and from the location of said spinning machine, said conveyor system further comprising a plurality of rail elements arranged in an array above and vertically distant from said spinning machine, said plurality of rail elements being provided with a plurality of bobbin locating means defining bobbin locations from which the bobbins can be spin-stripped by said spinning machine, and being supported independently of said spinning machine, the installation further including bobbin carriers individually interconnecting the bobbins with said rails and said rail elements and a common drive mechanism for driving said bobbin carriers, a rail member extending parallel to said rails, and a cleaner device mounted for displacement along said rail member, wherein said cleaner device and said carriers for said bobbins are driven by said common drive mechanism.

2. A spinning mill installation according to claim 1, wherein said bobbin locating means are detent devices associated with said rail elements at said bobbin locations.

3. A spinning mill installation according to claim 1, wherein said overhead conveyor system includes guides operatively connected to said rail elements for guiding slubbings from bobbins hanging at said bobbin locations into said spinning machine.

4. A spinning mill installation according to claim 1, wherein said cleaner device is entrained by the driven carriers of said bobbins.

5. A spinning mill installation according to claim 4, further including at least two spinning machines in spaced side-by-side relation, wherein said rail member is disposed between one of said rails of one of said at least two spinning machines and another one of said rails of the other of said at least two spinning machines, wherein the bobbin carriers associated with said one rail are driven in the opposite longitudinal direction relative to the bobbin carriers associated with said another one rail, the installation further including means for alternately engaging said cleaner device with said bobbin carriers on said one rail and with said bobbin on said another one rail, to be alternatively entrained therewith.

6. A spinning mill installation according to claim 1, wherein said cleaner device also is in quiding contact with at least one of said rails.

7. A spinning mill installation according to claim 1, further including at least two spinning machines in spaced side-by-side relation, wherein said common drive mechanism for driving said bobbin carriers is disposed in the space between said two spinning machines, and is associated with said two spinning machines.

8. A spinning mill installation according to claim 1, further including at least two spinning machines in spaced side-by-side relation, wherein said rail member for said cleaner device is disposed in the space between said two spinning machines, and wherein said cleaner device comprises a vertical tube having laterally projecting blower nozzles for simultaneously cleaning opposing sides of said two spinning machines.

9. A spinning mill installation according to claim 8, wherein said vertical tube also is provided at its upper portion with laterally directed cleaner nozzles for cleaning said overhead conveyor system.

* * * * *